US012140014B2

(12) United States Patent
Raglin et al.

(10) Patent No.: US 12,140,014 B2
(45) Date of Patent: Nov. 12, 2024

(54) SYSTEM AND METHOD FOR DETERMINING PUMP INTAKE PRESSURE OR RESERVOIR PRESSURE IN AN OIL AND GAS WELL

(71) Applicant: WellWorx Energy Solutions LLC, Midland, TX (US)

(72) Inventors: John M. Raglin, Fredericksburg, TX (US); Kenneth B. Nolen, Midland, TX (US); Russell J. Messer, Montgomery, TX (US)

( * ) Notice: Subject to any disclaimer, the term of this patent is extended or adjusted under 35 U.S.C. 154(b) by 355 days.

(21) Appl. No.: 17/034,769

(22) Filed: Sep. 28, 2020

(65) Prior Publication Data

US 2022/0098971 A1 Mar. 31, 2022

(51) Int. Cl.
*E21B 47/008* (2012.01)
*E21B 47/047* (2012.01)

(52) U.S. Cl.
CPC ..... *E21B 47/008* (2020.05); *E21B 47/047* (2020.05)

(58) Field of Classification Search
CPC ..... E21B 47/008; E21B 47/047
USPC ..... 73/152.51
See application file for complete search history.

(56) References Cited

U.S. PATENT DOCUMENTS 8,261,819 B1 9/2012 Gibbs et al.
8,621,819 B2 * 1/2014 Kayani ..... B64C 3/26 52/745.19
2012/0158310 A1 * 6/2012 Adams ..... E21B 47/06 702/12
2016/0003026 A1 * 1/2016 Adams ..... E21B 47/06 166/250.01
2017/0009544 A1 * 1/2017 Tseytlin ..... E21B 21/08
2020/0003035 A1 * 1/2020 Al-Gouhi ..... E21B 43/128

FOREIGN PATENT DOCUMENTS

CA 2203446 A1 * 4/1996

* cited by examiner

*Primary Examiner* — Tara Schimpf
*Assistant Examiner* — Patrick F Lambe
(74) *Attorney, Agent, or Firm* — Frost Brown Todd LLP

(57) ABSTRACT

A system and method are described to determine a pump intake pressure in a petroleum producing well. The system includes a controller at a well site of the petroleum producing well, a system of valves connected to pipes collecting the well casing gas produced from a casing annulus of the producing well. The valves are controlled by the controller and a pressure sensor measures the pressure of the well casing gas in the casing annulus. The system determines a well casing gas flow rate by measuring a build-up pressure of the well casing gas in a casing annulus when a valve from the casing annulus is closed. A fluid level in the casing of the well is determined using a pressure wave created in the well casing gas using the controller and the one or more valves. A fluid gradient correction factor is found using an actual fluid level in the casing. The controller then calculates the pressure using the gas flow rate, the fluid level and the fluid gradient correction factor.

9 Claims, 5 Drawing Sheets

SYSTEM AND METHOD FOR DETERMINING PUMP INTAKE PRESSURE OR RESERVOIR PRESSURE IN AN OIL AND GAS WELL

TECHNICAL FIELD

The present disclosure relates in general to oil and gas production techniques and in particular to systems and methods for determining pump intake pressure in oil and gas wells with artificial lift systems or reservoir pressure in a petroleum reservoir.

BACKGROUND OF THE INVENTION

Natural gas is usually produced in association with petroleum in so-called 'oil and gas' wells. Hydrocarbon wells usually produce water in addition to the oil and gas components. Without lifting liquid to the surface by external means, back pressure is exerted on the reservoir which impedes (or even stops) production into the well. Rod pumping is a frequently used method for lifting liquid to the surface. This system of equipment involves a surface reciprocating machine connected to a positive displacement subsurface pump with a string of sucker rods. Rod pumping has the ability to produce a low back pressure on the reservoir, which allows oil and gas to be produced to the surface at greater rates. While rod pumping is most commonly used, any artificial lift method that is vented is a candidate application for this invention.

FIG. 1A shows a typical oil and gas well artificially lifted with rod pumping equipment 100. Generally, equipment 100 includes a pump 101 and rods 102, which are reciprocated with a surface pumping unit (not shown). Oil, gas and water comes into the wellbore and the liquids (oil and water and a small amount of gas) are pumped to the surface through tubing 103 and free gas travels to the surface through the annulus between tubing 103 and casing 104. Good production practice strives to vent as much as possible of the free gas upward through the casing-tubing annulus and check valve 105. A gas separator 106 discourages free gas from passing through pump 101 where it would otherwise severely diminish volumetric efficiency of the lift system.

FIG. 1B is a more detailed diagram of gas separator 106. Oil, water and/or gas enter the wellbore from the reservoir through casing perforations/open hole 107. In general, some of the gas is dissolved in the oil and some is free, i.e. in the gaseous state. Gas separator 106 is designed to separate and vent most of the free gas up the casing-tubing annulus. The free gas moving upward from the casing perforations generally will continue upward in the annulus past the tubing perforations 108.

The liquid (water and oil containing dissolved gas) is forced to move through tubing perforations 108 where it is moved into pump 101 through dip tube 109. Hopefully, most, or all, of the free gas is removed by gas separator 106. Several different types of gas separators are available. All have the same purpose, i.e. to vent as much free gas as possible up the casing-tubing annulus. When it reaches the surface, the free gas is mixed with the oil, water and gas that passed through the pump and up the tubing 103 (FIG. 1A). Check valve 105 prevents produced fluids from falling back down the casing-tubing annulus.

The weight of the liquids and the gas in casing-tubing annulus imposes a pressure at the pump intake. This pump intake pressure can be an important data point in evaluating and operating the well. Traditional methods of calculating or estimating pump intake pressure from various parameters available at the surface of the well have been subject to large errors when compared to pump intake pressures measured by sensors in the well in the well. Placing sensors in the well at the pump intake is expensive and difficult in most circumstances. What is needed is a more accurate system and method for determining pump intake pressure that can be determined from parameters measured at the surface.

BRIEF SUMMARY OF THE INVENTION

In a preferred embodiment of the invention a method for calculating a pressure in well producing a combination of oil water and/or gas, the producing well having a liquid level and a well casing gas is described. The method includes determining a well casing gas flow rate at the surface of the well by measuring a well casing gas build up pressure in a casing annulus when a valve to the casing annulus is closed and determining a fluid level in a casing of the well from the surface using a pressure wave caused in the well casing gas. The method then determines a fluid gradient correction factor using an actual fluid level in the casing and calculates the pressure using the gas flow rate, the fluid level and the fluid gradient correction factor.

In another preferred embodiment, a system for determining a pressure in a producing well having a well casing gas and a well fluid therein, the system includes a controller at a wellhead of the petroleum producing well, one or more valves connected to pipes collecting the well casing gas produced from a casing annulus of the producing well, the one or more valves controlled by the controller, and a pressure sensor measuring the pressure of the well casing gas in the casing annulus. The system determines a well casing gas flow rate by measuring a build up pressure of the well casing gas in a casing annulus when a valve to the casing annulus is closed. A fluid level in the casing of the well is determined using a pressure wave caused in the well casing gas using the controller and the one or more valves. A fluid gradient correction factor is found using an actual fluid level in the casing. The controller then calculates the pressure using the gas flow rate, the fluid level and the fluid gradient correction factor.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1A:
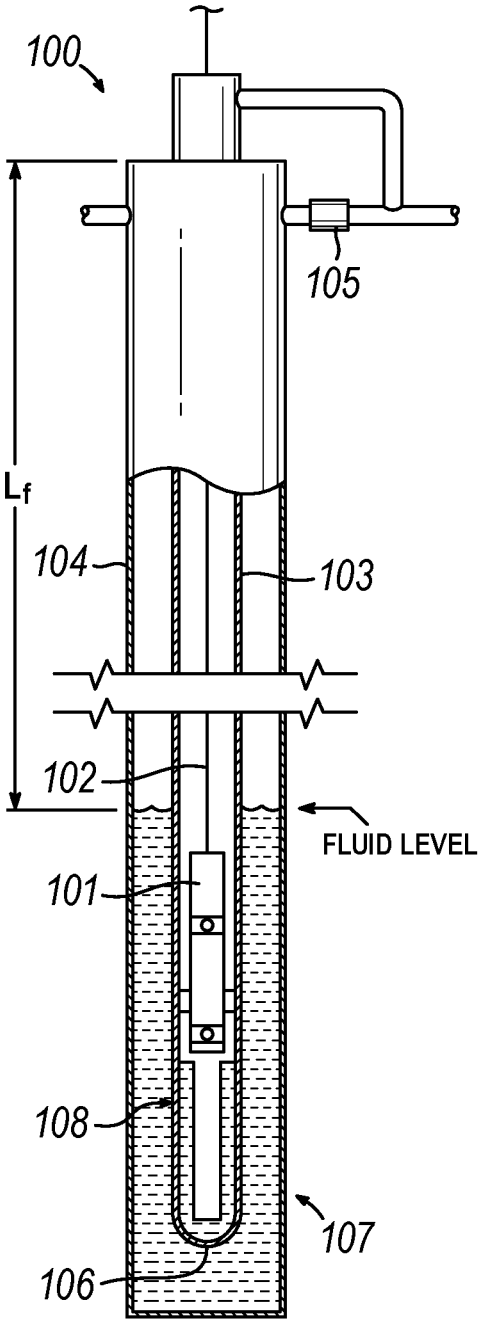
FIG. 1A (PRIOR ART)
FIG. 1A is a diagram of a portion of a typical pumping system for an oil and gas well.

Wells may be drilled to extract any number of resources, but most often those resources include oil, gas and/or water, individually or in some combination. Such wells can be referred to as producing wells. In oil and gas wells in particular, the production stream is separated into volumes of oil, water and gas. The oil and gas components are measured and sold. The water is disposed-of unless it is suitable for agricultural or human use. Measurement of gas is most commonly done with orifice meters. In the United States, gas measurement is guided by the American Gas Association (AGA). A carefully machined orifice plate is placed in the gas stream in a meter run. The meter run is designed to minimize turbulence in the line to increase accuracy of the measurement. Gas pressure upstream of the orifice plate is measured along with differential pressure across the orifice plate. Temperature of the gas in the flow stream is also measured. Also, gas specific gravity (SG) determined from a gas sample analysis is required. Using equations specified by AGA, the rate of gas flowing through the meter run is computed in standard cubic feet (scf) at 14.65 psia pressure and 60 deg F. temperature. Well controllers and other computers can take measurements of the well conditions and calculate parameters that can then be used to operate the well, such as the operating parameters of a rod pump or submersible pump system.

One critical parameter in operating artificial lift systems is the pump intake pressure, which is the pressure of the gas and fluid at the intake to the pump. Some submersible pump systems can place a pressure sensor at the on the pump that is connected to the surface using the electrical cabling used to run the pump. However, having a pressure sensor at the pump intake is not always feasible or economically justifiable. In rod pumped wells the electrical cabling to connect to the sensor does not exist and environmental conditions inside the well can lead to sensor failure. Instead of trying to place pressure sensors at the pump intake, other methods attempt to calculate pump intake pressure from data that can be collected at the surface. Data related to the height of the fluid in the well bore and the amount of gas being produced by the well bore, as well as the chemical composition of the fluid and gas products of the well can have been used to estimate pump intake pressure. These calculations of pump intake pressure, however, are subject to large errors and have been found to significantly overestimate the pump intake pressure, particularly in wells that are producing a significant amount of gas.

Two data points that are involved in most calculations of pump intake pressure are fluid level within the casing annulus (the area between the inner diameter of the casing and the outer diameter of the tubing), and the gas production or flow rate in the casing annulus. The gas flow rate can be inferred from measuring the gas pressure build up in the casing when the valve allowing the gas to escape from the casing is closed. According to the principles of the present invention, inferred means the process of determining gas production by means other than direct measurement with a standard orifice meter. As mentioned, the process of inferring the gas flow rate requires knowledge of fluid level in the casing and involves brief measurements of pressure buildup rates when the surface casing valve is closed.

The casing/tubing annulus (i.e., the annulus between casing 104 and tubing 103 of FIG. 1A) forms a volume of gas from the fluid level upward to the surface. Gas is flowing into the volume at the liquid-fluid level interface. With the casing closed, pressure in the volume increases because the gas is trapped. Pressure buildup is measured at the surface. The present invention uses gas laws to calculate the rate of gas inflow into the (fixed) volume from the measured pressure buildup. Since the buildup measurement time is short (say 1 minute), the reservoir hardly knows that the surface casing valve has been closed. Thus, the inflow rate during the pressure buildup measurement is virtually the same as the inflow rate during normal operation with the casing valve open.

A detailed description of a method of using the pressure build up to determine gas flow rates can be found in U.S. Pat. No. 8,261,819 to Gibbs et al., the contents of which are hereby incorporated by reference. Measuring inferred gas flow in this manner allows the gas flow rate to be measured multiple time per day, such as every 10 minutes or 144 time/day. Traditionally gas flow rates are measured using an orifice flow meter measuring the total gas flowing from the well. Casing gas flow rates are not traditionally measured. As gas flow rates can change drastically from moment to moment, having many measurements per day that can be normalized to an average flow rate allows for more accurate input data to the pump intake pressure calculation as described below. The single measurement may be drastically off from the actual flow rate depending on well conditions at the time the measurement was taken.

Any of many well-known methods may be used to determine the fluid level. At least two are described in the '891 patent to Gibbs. One method sends a rarefaction wave down the annulus in search of the fluid level. The other method sends a compressive wave down the annulus to locate the fluid level. Both of the methods are 'green' i.e. no gas is vented to the atmosphere and no foreign substance is injected into the well. Either method will return a fluid level that can be used in the pump intake pressure calculation.

Figure 2:
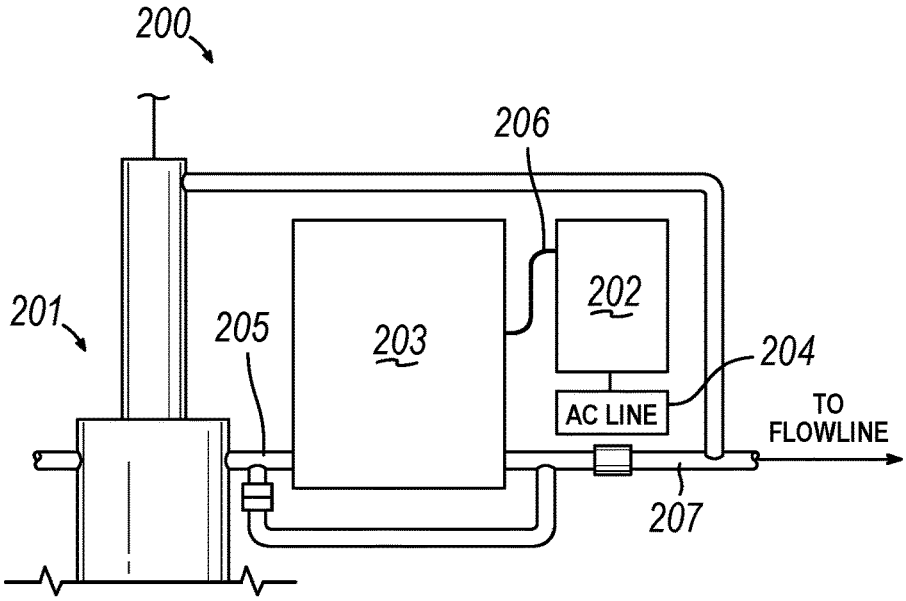
FIG. 2 is a diagram of an embodiment of a wellhead showing a possible configuration of equipment at the wellhead according to concepts described herein.

Referring now to FIG. 2, an embodiment of an equipment installation 200 at a wellhead that is capable of automatically taking the required measurements to determine gas flow rates and fluid levels is shown. Units 202 and 203 installed at or near the wellhead 201 include the measuring and processing hardware for implementing the principles of the present invention and will be discussed in detail below. While a permanently mounted system is shown in FIG. 2, a mobile system can also be used and is well within the scope of the concepts described herein. Tradeoffs, however, may exist between the permanent and mobile systems. Permanent systems may be able to take multiple readings of the gas flow rate and fluid level per day allowing an average rate to be calculated and used. A mobile system may only be used to take one or a few sets of measurements possibly making the gas rate and fluid level calculations less accurate over the long term. A mobile unit, however, may be used on multiple wells per day decreasing the relative equipment costs of the mobile unit.

Referring again to FIG. 2, electrical equipment unit 202 preferably includes computer/monitor units, data acquisition module (DAM), D-C power supply, and a set of relays for opening/closing the electrical valves in mechanical equipment unit 203. The DAM performs the dual function of analog to digital conversion (A-D) and signaling the relays to open and close the electric valves. Electrical equipment unit is supplied with 115 v A-C power through A-C line 204. While a local controller or processor is shown in FIG. 2, the location of the majority of the data and computer processing can be done either locally at the controller or remotely at a dedicated data center or in the cloud. The local controller can be used to gather the measured data and then send that data to a facility remote from the well for further processing. Similarly, instructions or control data can be generated locally or can be sent from remote computing resources to the well to be implemented by a local controller or other electrical equipment.

Electrical equipment unit 202 is connected to mechanical equipment unit 403 with a multi-conductor shielded cable 206. Electrical equipment unit 202 is preferably configured the same (number of relays excepted) way regardless of the features of the invention being implemented in various forms of mechanical equipment unit 203. Electrical equipment unit 202 may be located near the pumping unit motor control box (not shown) and connected to mechanical equipment unit 203 with a buried electrical cable 206 in conduit or may be remote from the well site. The function of a controller in electrical equipment 202 can also be any combination of local and remote control or processing elements. Local processing can occur in a controller at or near the well site and additional processing may occur at a remote site or in the cloud. Local processing may be limited to collecting and transmitting data to a remote processor or cloud based processing.

In preferred embodiments, mechanical equipment unit 203 is connected to the annulus using pipe or hose 205, which brings in gas from the annulus. The outlet 207 of mechanical equipment unit 203 connects to the flowline downstream of the point where annular gas is recombined with tubing fluids in the standard wellhead.

The embodiment of mechanical equipment unit 203 is capable of inferring gas production in a well and determining fluid level. The digital computer/monitor system of electrical equipment unit 202 keeps track of time and performs the calculations. At the appropriate time digital computer/monitor system signals an electrically controlled valve in mechanical equipment 203 (normally open) to close. Immediately thereafter it signals the A-D converter within DAM to digitize pressure data supplied by a pressure transducer in mechanical equipment 203 for a specified period of time. The computer/A-D converter systems stores the measured casing pressures as pressure increases. After a pre-determined buildup time, the digital computer/monitor system signals the electric valve to open. Digital computer/monitor system then computes the pressure buildup rate dp/dt and solves for instantaneous mcf/d. It stores all of the computed rates during the day.

The system 200 may also be used to determine fluid level. To illustrate, a description of an example of creating a green rarefaction wave to seek the fluid level is described using mechanical equipment unit 203. First, the ambient casing pressure is measured with a pressure transducer by sampling pressure at 5 hz for one minute. Ambient casing pressure is taken to be the average of these 300 samples. Next, energy for creating the rarefaction wave is stored in the casing annulus. Specifically, to store energy, computer/monitor system in electrical equipment 202 signals the DAM to close the valve to the casing annulus and to operate the A-D converter at 1 hz to monitor increase in annulus pressure. When the pressure increases a pre-selected amount above ambient pressure, the A-D process is stopped. If the well is shallow, an overpressure of 2 psi might be sufficient to receive an echo from the fluid top in the annulus. If the well is deep or if the annulus is small, a larger overpressure (say 10 psi or more) might be required.

When the desired overpressure (above ambient) is reached the A-D converter is stopped. The A-D converter is restarted at a selected speed, say 500 hz and samples for 0.50 sec to provide a pressure baseline and then the valve is opened briefly for a specified time, say 0.5 sec, and then re-closed. A rarefaction wave in the casing is formed. Pressure downstream of the valve is ambient pressure, say 30 psi while pressure upstream is higher, for example 40 psi. When the valve is briefly opened, gas rushes from high pressure toward low pressure. Pressure in the flowline is increased slightly and pressure in the annulus is decreased slightly (rarefaction). The A-D converter is running at 500 hz for a pre-selected amount of time to allow the wave to travel to the fluid top and return to the surface. A surge chamber located downstream of the valve enhances the rarefaction wave by creating a high inrush of gas from the casing annulus.

The rarefaction wave travels down the annulus, echoes off the fluid top and returns to the surface. When the specified sampling time elapses, the DAM is told to stop the A-D converter and to open the valve. Normal operation is resumed. The travel time is used to calculate fluid level based on the properties of the gas in the annulus.

Figure 3:
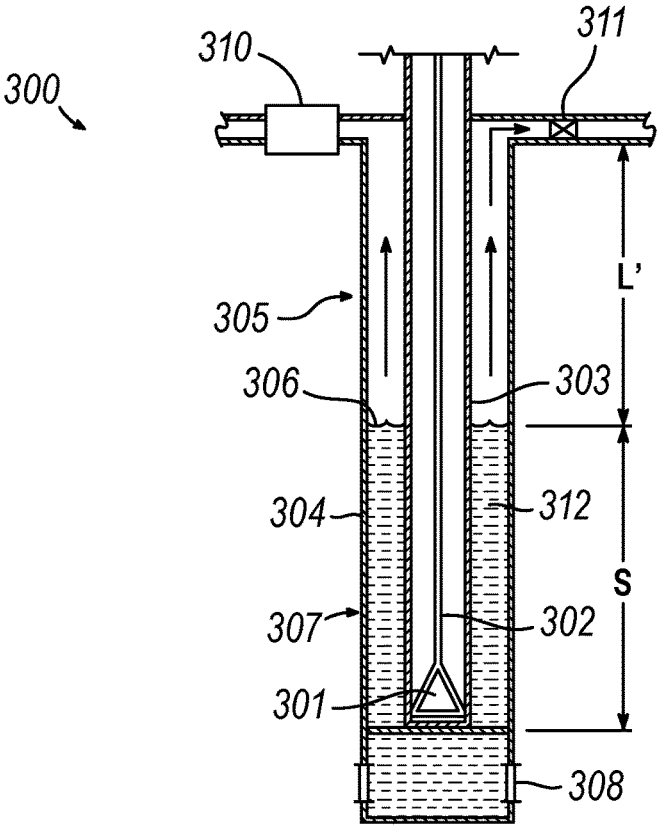
FIG. 3 is a diagram of a well bore showing a gassy oil column.

Referring now to FIG. 3, a diagram of a production petroleum well is shown. As described, well 300 is formed by casing 304 lining the interior of the well bore. Pump 301 is used to draw fluid into tubing 303 and pump the fluid and entrained gas out of the well bore. Free gas (305) in the casing rises and flows out through valve 311. Fluid 312 flows into the well through perforations 308 in the casing and creates a fluid level boundary 306 in the casing 304.

Having obtained the gas flow rate of the free gas 305 and the fluid level 306, the pump intake pressure can be calculated using additional information related to the properties of the fluid and gas in the well, which can be obtained from performing a chemical analysis on the well products. The pump intake pressure can be calculated as follows:

$$P_i = C_p + G_p + (O_g \times C \times H) \quad \text{(eq. 1)}$$

Where $P_i$ is the pump intake pressure, $C_p$ is the pressure in the casing at the surface, $G_p$ is the gas column pressure at the fluid level determined using the composition of the well gas, $O_g$ is the stock tank oil gradient measured with a hydrometer, C is the casing fluid gradient correction factor and H is the height of the fluid in the casing, typically above pump or other selected datum.

Figure 4A:
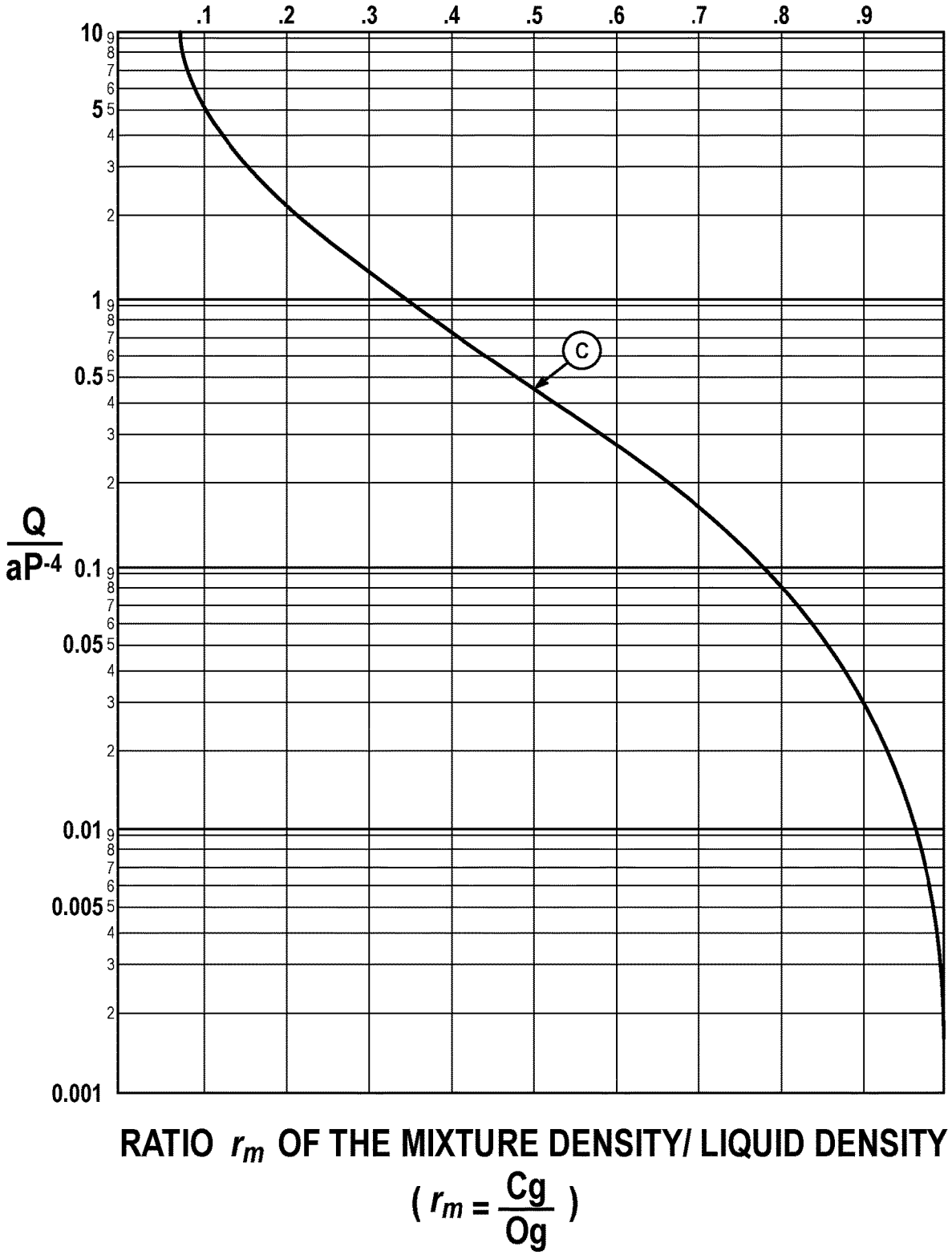
FIGS. 4A and 4B are plots of a "Gilbert's Curve" and a modified "Gilbert's Curve", respectively.
Figure 4B:
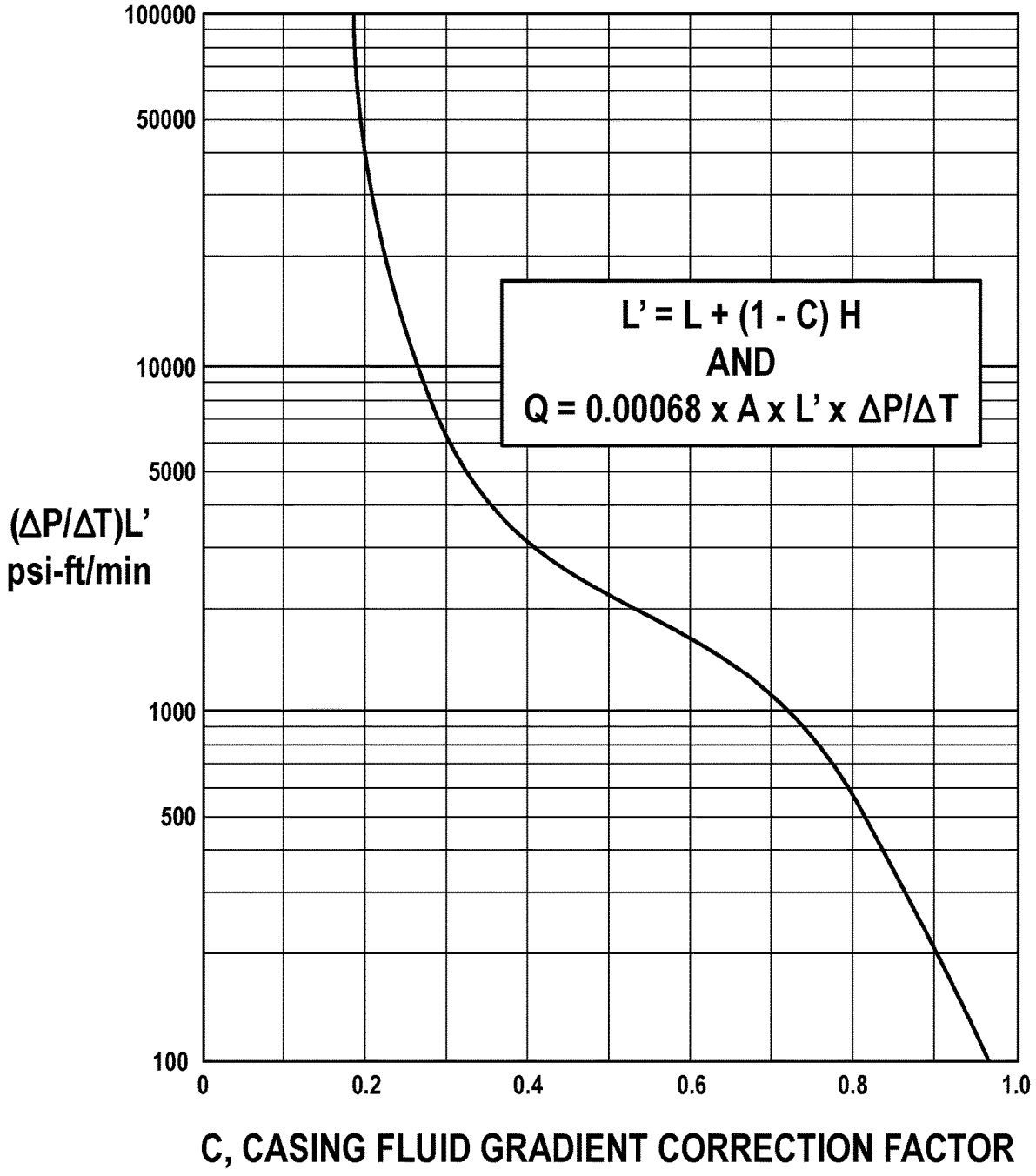

As can be see, all of the variables of the formula are known, or produced from readily available well data, except for C, the casing fluid gradient correction factor. The correction factor is found by using the Gilbert S Curve. The original Gilbert "S" Curve is Shown in FIG. 4A while the current industry standard Modified Gilbert S Curve is shown in FIG. 4B. The original Gilbert S Curve was created empirically from measured well data. See FIG. 4A for definition of terms and plots of $Q/aP^{(.4)}$ against $r_m$. The original curve was developed using daily gas rate measurements taken at the surface using an orifice meter. However, in practice it is not economically feasible to have a permanently installed orifice meter on individual wells. To solve this problem another method was developed to measure the casing gas rate which requires a fluid level and a shut-in casing pressure buildup. Typically, the casing vent valve is manually closed for only one minute to measure a buildup pressure. Knowing the fluid level and the tubing and casing dimensions the casing annulus volume can be calculated. Assuming that the fluid level and buildup does not change, a daily gas rate can be calculated using the gas law equations. This procedure to infer the casing gas rate along with a modified version of Gilbert's S Curve were developed to calculate a pump intake pressure. See FIG. 4B for definition of terms and plots of $(\Delta P/\Delta T)\times L'$ against C. Note that C and $r_m$ are equivalent, both are ratios of oil column density in the well casing annulus which usually contains gas and stock tank oil density. Once C or $r_m$ are determined the pump intake pressure can be calculated using eq. 1.

Calculations of pump intake pressure using the Modified Gilbert S Curve is currently the industry standard method; however, inaccurate calculations of pump intake pressure are common especially in gassy wells with high fluid levels. In development of the present invention flaws were found in the determination of correction factor, C, from the Modified Gilbert S Curve. As can be seen in FIG. 4B, the industry standard method plots the vertical axis of the modified Gilbert Curve plot using the formula:

$$(\Delta P/\Delta T)\times L' \quad \text{(eq. 2)}$$

Where:

$$L'=L+(1-C)\times H \quad \text{(eq. 3)}$$

L' is the adjusted fluid level depth that includes not only the free gas above the fluid level but also the gas bubbles in the oil column 307. Unfortunately, eq. 2 and eq. 3 include a gross error that returns inaccurate measurements, especially at high gas flow rates. The equations use the gas in the fluid column but the bubbles of gas in the oil column can contribute to the buildup only after escaping from the oil column into the space above the fluid level. Further, the pressure buildup used to calculate the daily casing gas rate only effects the free gas above the fluid level. The fluid level interface apparently acts as a barrier and the gas bubbles in the fluid below the fluid level are not significantly affected by this small buildup. Because of this error in the model the industry standard method erroneously calculates casing gas rates that are higher than actual. Therefore, with higher than actual gas rates the casing oil gradient is lower than actual and this results in calculating a pump intake pressure that is lower than actual.

In other words, by using L', the industry standard method of calculating pump intake pressure have been found to overestimate the gas rate. L', as can be seen from eq. 3, adds gas in the fluid to the gas above the fluid level which results in overestimating the gas flowing up the casing in the well. This results in a lower than actual oil column gradient and thereby underestimating the pump intake pressure. The present invention corrects for this error by using only the gas calculated from the casing annulus volume above the fluid level instead of an adjusted fluid level L'. By removing the gas entrained in the oil below the fluid level from the calculation, a more accurate correction factor can be determined and therefore a more accurate pump intake pressure can be calculated.

Additionally, another adjustment can be made to further increase accuracy of the calculation of pump intake pressure by adjusting the contribution of the free gas in the casing annulus volume from the fluid level to the surface to account for the chemical makeup of the gas that differs from the ideal gas laws. A factor K is included in the gas law equation to determine the daily flow rate more accurately, where:

$$K=C_p/C_v \quad \text{(eq. 4)}$$

Cp and Cv are known specific heat constants obtained from a chromatography gas analysis. Improving the accuracy of the casing gas flow rate improves the accuracy of the pump intake pressure calculation over the existing industry standard method. The equation for calculating the daily gas rate from pressure buildups is:

$$Q=(79004\times K\times V/1544\times Z\times T_{average})\times\Delta P/\Delta T \quad \text{(eq. 5)}$$

Where, Q is the daily gas rate, in MCFPD; K is the ratio of specific heats; V is the casing volume in $ft^3$, Z is the gas compressibility in psi; $T_{average}$ is the average gas temperature above fluid level in $^0R$; and $\Delta P/\Delta T$ is the pressure buildup in psi/min.

Therefore, according to the concepts described herein, the pump intake pressure of an artificial lift well can be accurately calculated. The calculation uses a normalized gas flow rate determined from the plurality of collected build up measurements, uses the measured fluid height and not an adjusted fluid height, and adjusts for free gas flowing rates by applying a K factor. The pump intake pressure is then used to operate the well to maximize production from the well without subjecting the well to over-pumping conditions which increases operating costs.

Figure 1B:
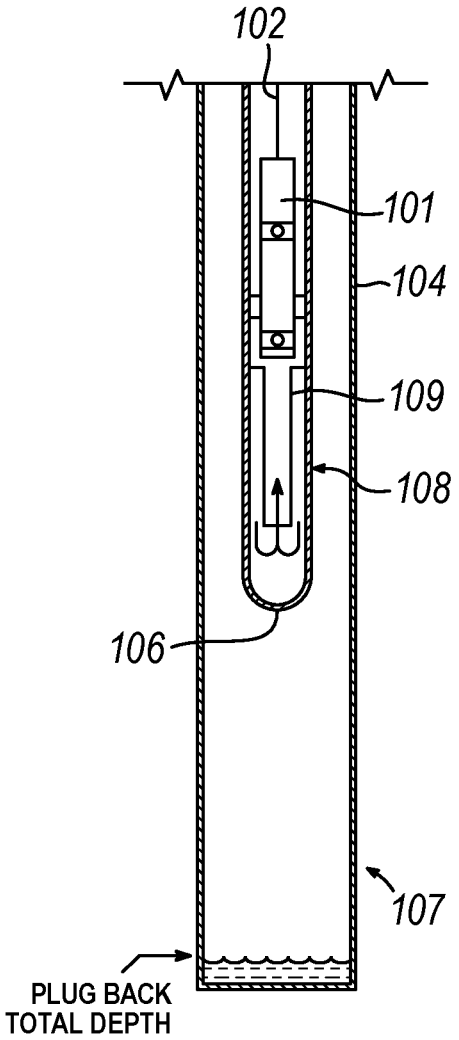
FIG. 1B (PRIOR ART)
FIG. 1B is a diagram of the typical gas separator used in an oil and gas well.
Figure 5:
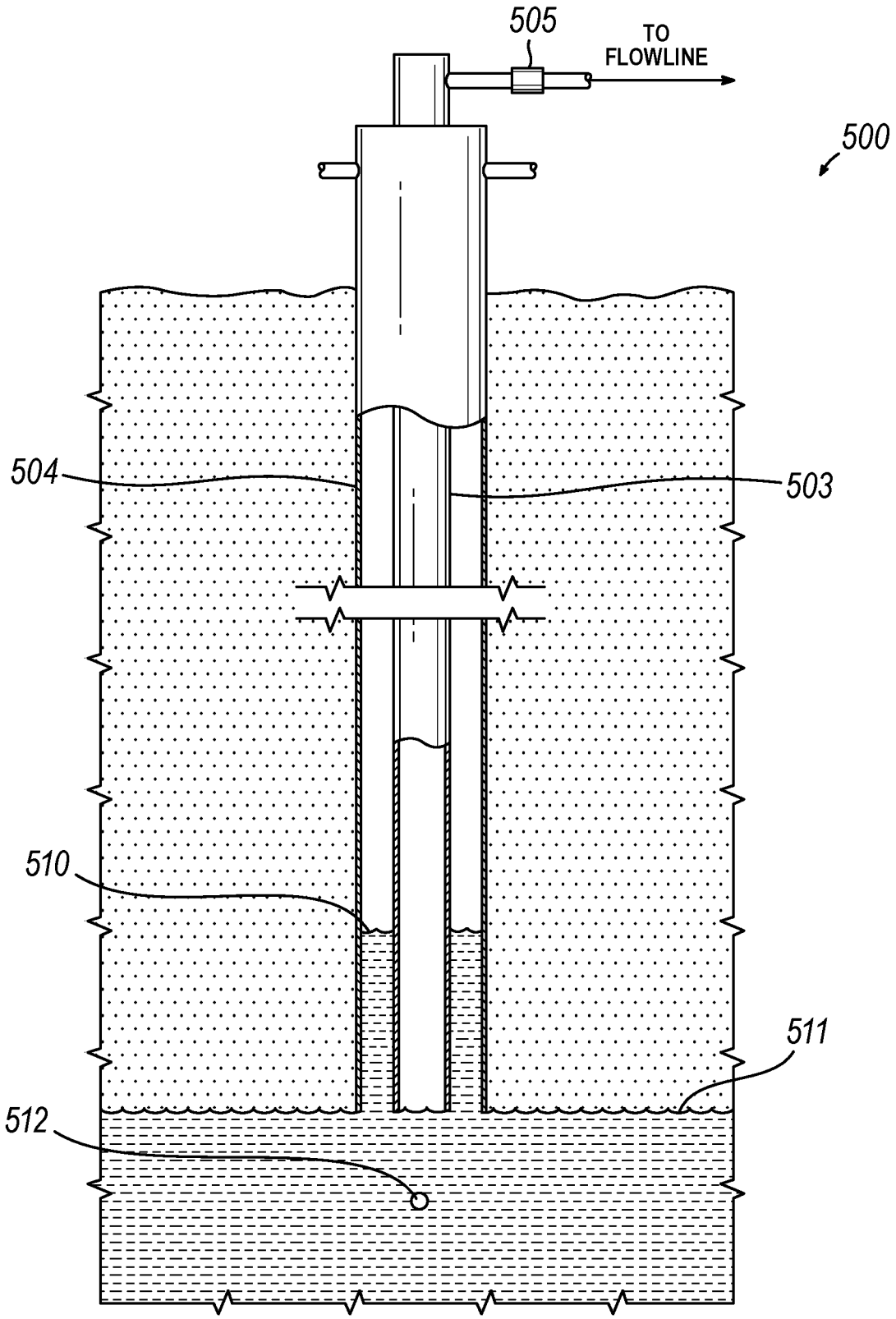
FIG. 5 is a diagram of a petroleum reservoir from which a reservoir pressure can be calculated according to the concepts described herein.

Referring now to FIG. 5, a petroleum reservoir 500 is shown. While the present invention has been described as useful in determining pump intake pressure for artificially lifted wells, the system and method can also be used in gas wells or reservoirs where no artificial lift system is present. In the case of a reservoir without of a pump, the concepts described herein can be used to determine a reservoir pressure associated with the petroleum reservoir. The petroleum reservoir, as with the artificially lifted well described in FIG. 1, has a wellhead 505, casing 504 and tubing 503. The reservoir 511 itself has a volume of petroleum that exhibits a pressure causing a fluid level to exist at some point in the well bore. Using the fluid level and gas flow rate, found as described above, a reservoir pressure at the mid-point 512 of the reservoir 511 can be calculated. While a mid-point in an exemplary reservoir is shown, the present system and method can be used to calculate pressure at any datum in the well. Examples of other datum of interest could be the pressure at a horizontal section of a horizontally drilled well or at the mid-point in the curve in the transition between the vertical or horizontal portions of the well string. Other interesting datum points can easily be imagined and are well within the scope of the concepts described herein.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for calculating a pressure at a producing well having a fluid level of a fluid and a well casing gas, the method comprising:

determining a well casing gas flow rate at the surface of the well by measuring a well casing gas build up pressure in a casing annulus when a valve from the casing annulus is closed;

determining a fluid level in a casing of the well from the surface using a pressure wave created in the well casing gas by closing a valve at the surface to create an overpressure in the casing annulus and then temporarily opening the valve a length of time to thus generate the pressure wave, a transit time for the pressure wave is then measured and the fluid level in the casing is calculated from the transit time;

determining a fluid gradient correction factor using an actual fluid level in the casing, wherein determining the fluid gradient correction factor includes removing gas entrained in the fluid below the fluid level from the determination;

calculating the pressure using the well casing gas flow rate, the fluid level and the fluid gradient correction factor; and pumping the fluid with a pump, wherein the pump uses an operating parameter that is based on the calculated pressure to pump the fluid.

2. The method of claim 1, wherein the pressure is a pump intake pressure.

3. The method of claim 1, wherein the pressure is at any datum in the well.

4. The method of claim 1, wherein the well casing gas flow rate is determined from a plurality of well casing gas flow rate measurements taken over a period of time.

5. The method of claim 1, wherein determining the well casing gas flow rate and the fluid level is done by a combination of valves and a controller associated with the producing well.

6. The method of claim 5, wherein the combination of valves and the controller are permanently mounted to the well.

7. The method of claim 5, wherein the data processing is done remotely from the producing well.

8. The method of claim 1, wherein a factor K is used to calculate the flow rate of the well casing gas.

9. The method of claim 1, wherein the actual fluid level is a fluid level determined without adding gas in the fluid column below the fluid level.

* * * * *